United States Patent [19]

Bamburg et al.

[11] 4,127,230

[45] Nov. 28, 1978

[54] BULK CONTAINER WITH HINGED LOCKING TOP

[75] Inventors: Robert A. Bamburg, West Monroe; Roger M. Floyd, Monroe; Farris N. Duncan, West Monroe, all of La.

[73] Assignee: Olinkraft, Inc., West Monroe, La.

[21] Appl. No.: 816,535

[22] Filed: Jul. 18, 1977

[51] Int. Cl.[2] ..... B65D 5/68

[52] U.S. Cl. ..... 229/45 R; 229/43

[58] Field of Search ..... 229/43, 44, 45

[56] References Cited

U.S. PATENT DOCUMENTS

| | | | |
|---|---|---|---|
| 1,473,432 | 11/1923 | Huye | 229/43 X |
| 1,582,375 | 4/1926 | Bliss | 229/45 |
| 1,646,665 | 10/1927 | Smith | 229/45 |
| 2,711,282 | 6/1955 | D'Esposito | 229/45 |
| 2,809,775 | 10/1957 | White | 229/45 X |
| 3,116,007 | 12/1963 | D'Esposito et al. | 229/45 |
| 3,692,231 | 9/1972 | Neitzke et al. | 229/45 |

*Primary Examiner*—Davis T. Moorhead

*Attorney, Agent, or Firm*—O'Brien and Marks

[57] ABSTRACT

A bulk container has a hinged top with narrow side panels and a front locking panel assembly including an outside panel and an inside panel wherein a horizontal locking edge is formed on the inside panel for being engaged by a tab or the like folded downward from the front top edge of the container. An opening extends through both the inside and outside panels of the top in alignment with the tab for disengaging the tab from the locking edge.

6 Claims, 13 Drawing Figures

FIG. 1
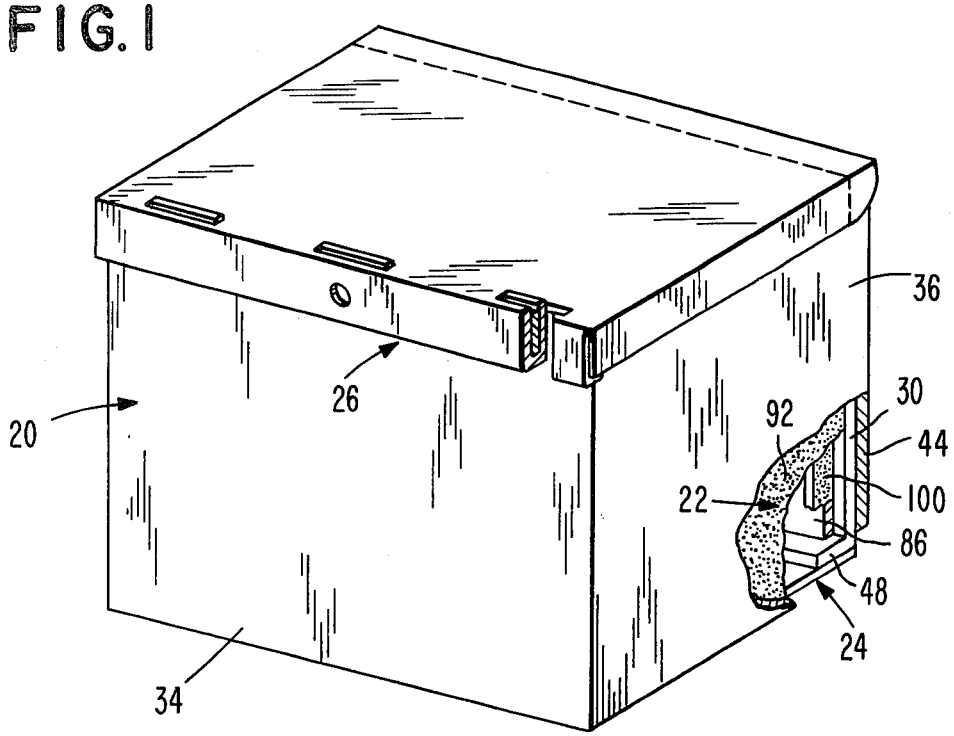
FIG. 2
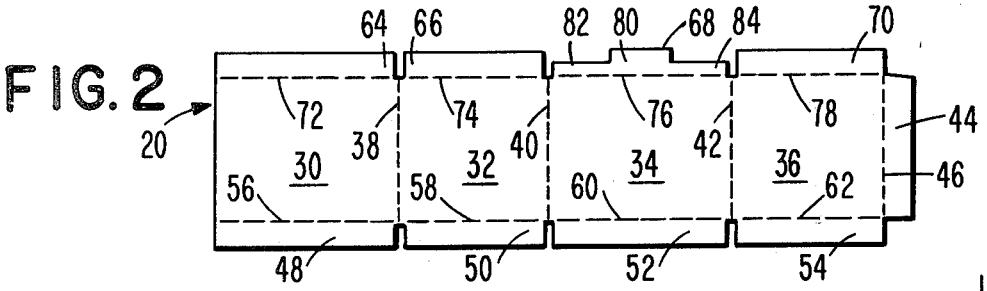
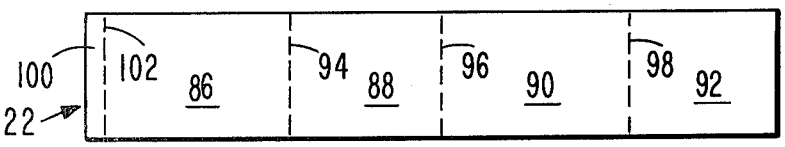
FIG. 3
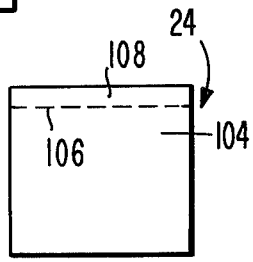
FIG. 4
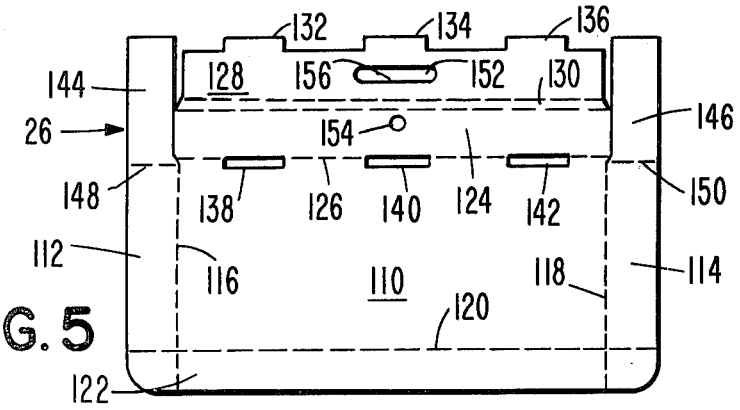
FIG. 5

BULK CONTAINER WITH HINGED LOCKING TOP

BACKGROUND OF THE INVENTION

1. Field of the Invention

This invention relates to bulk material containers made from paperboard and the like.

2. Description of the Prior Art

A number of prior art bulk containers, such as disclosed in our U.S. Pat. No. 3,979,045, employ top covers or caps which fit over the top portion of the container; such top caps are sometimes difficult to position on a container due to the bulge of the unit from bulk material when full, and further such top caps tend to burst or work loose. Thus with such prior art containers, it is often required to utilize steel straps or tape to hold the top cap securely in place.

The prior art, as exemplified in U.S. Pat. Nos. 2,369,387, 2,559,320, 2,580,586, 3,326,447, 3,512,699, and 3,958,747, also contains a number of containers with covers having locking features for locking the covers on the containers. However, some of such covers cannot be used on bulk material containers due to the forces on the containers from bulk material, and further such covers cannot be readily removed without damage so that the container can be reused after removal of the contents.

SUMMARY OF THE INVENTION

The invention is summarized in a bulk material container including an integral body having four side body panels with means serially connecting the body panels for forming an enclosed wall; bottom means for closing the bottom of the enclosed wall; a top hinged on a top edge of a rear body panel of the four body panels; the top including a top panel for covering the top of the enclosed wall, two narrow top side panels for extending downward over top portions of respective opposite side body panels of the four body panels, and front panel means for extending downward over a top portion of a front body panel of the four body panels; the front panel means including outside panel means and inside panel means for being folded inside the outside panel means; the inside panel means including means for forming a horizontal locking edge spaced below a front top edge of the front body panel; tab means hinged on the front top edge of the front body panel for being bent outward and downward to permit closing of the top but being resilient so as to be biased outward to engage the locking edge; and the outside panel means and the inside panel means having an opening therethrough in alignment with the tab means for permitting forcing of the tab means toward the front body panel to disengage the tab means from the locking edge.

An object of the invention is to construct a bulk material container with a top that can be locked on the container to resist bulging forces and to close the container but can also be readily removed.

Another object of the invention is to eliminate the necessity of steel straps and tapes for securing tops on bulk material containers.

It is also an object of the invention to provide a unitary container which can be easily assembled from an unassembled or partially unassembled state.

A further object of the invention is to provide a container attached to a pallet wherein the container can be folded flat on the pallet for shipping and storage purposes.

An advantage of the invention is that the top of a container can be readily closed in spite of bulging of the top of the container from the pressure of bulk material therein.

Other objects, advantages, and features of the invention will be apparent from the following description of the preferred embodiments taken in conjunction with the accompanying drawings.

BRIEF DESCRIPTION OF THE DRAWINGS

FIG. 1 is a perspective view with portions broken away of a bulk material container in accordance with the invention.

FIG. 2 is a plan view of a blank for forming a body portion of the container of FIG. 1.

FIG. 3 is a plan view of a blank for forming a liner of the container of FIG. 1.

FIG. 4 is a plan view of a blank for forming a bottom flap for the container of FIG. 1.

FIG. 5 is a plan view of a blank for forming a top for the container of FIG. 1.

DESCRIPTION OF THE PREFERRED EMBODIMENTS

Figure 6:
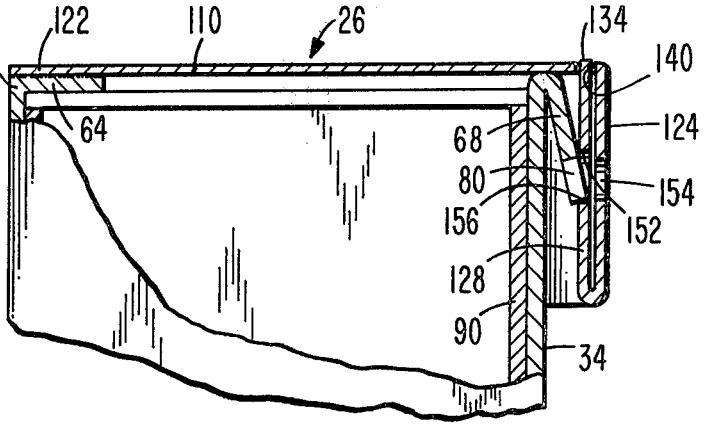
FIG. 6 is a cross section view of a top portion of the container of FIG. 1.

As illustrated in FIG. 1, the invention is embodied in a bulk material container having a body portion indicated generally at 20, a liner indicated generally at 22, a bottom closing flap indicated generally at 24 and a top indicated generally at 26.

The body portion 20 is formed from a cut and scored blank, shown in FIG. 2, having four side or outer wall panels 30, 32, 34 and 36 with a score line 38 between the panels 30 and 32, a score line 40 between the panels 32 and 34 and a score line 42 between the panels 34 and 36 to serially hinge the panels together. A side joint flap 44 is hinged at a score line 46 at the right end of the series of outer wall panels on the panel 36. Bottom short flaps 48, 50, 52 and 54 are hinged at score lines 56, 58, 60 and 62 defining bottom edges of the respective side panels 30, 32, 34, and 36. Top short flaps 64, 66, 68 and 70 are hinged at score lines 72, 74, 76 and 78 on the top edges of the respective panels 30, 32, 34 and 36. The short flap 68 hinged on the top edge of a front panel 34 of the series of wall panels includes a center portion 80 and side portions 82 and 84 with the side portions 82 and 84 having a width, i.e. vertical dimension in FIG. 2, which is substantially less than the width of the other top flaps 64, 66 and 70 to form a tab in the portion 80.

The liner 22, shown in FIG. 3, includes side or inner wall panels 86, 88, 90 and 92 serially hinged together at respective score lines 94, 96 and 98. A joint flap 100 is hinged at score line 102 to the left end of the series of liner panels on end panel 86. The panels 86, 88, 90 and 92 are designed to be bonded such as by glue (shown by stipling in FIG. 1) to the inside surfaces of the outer wall panels 30, 32, 34 and 36.

Figure 8:
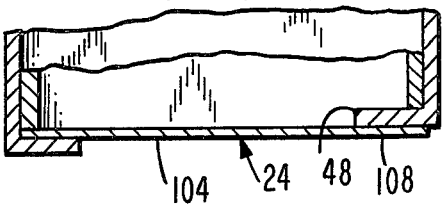
FIG. 8 is a cross section view of a bottom portion of the container of FIG. 1.

As shown in FIG. 4, the bottom flap 24 is formed as a separate rectangular panel 104 which has a score line 106 thereacross forming a side portion 108 of the panel 104 which corresponds to the width of the bottom short panel 48. The dimensions of the panel 104 are selected such that when the container is assembled as shown in FIGS. 1 and 8, the edge portions of the panel 104 engage the bottom edges of the liner panels 88, 90, and 92 while freely fitting within the walls formed by the panels 32, 34 and 36.

The top 26 is formed from a separate blank as illustrated in FIG. 5 and has a rectangular top panel 110 with short side panels 112 and 114 hinged at respective score lines 116 and 118 on opposite side edges of the top panel 110. A score line 120 is formed across the panel 110 and the short side panels 112 and 114 to form a narrow rear portion thereof corresponding to the width of the short top flap 64, FIG. 2, of the body 20. Locking front panel means is formed on the top 26 by an outside front panel 124 hinged at a score line 126 on the front edge of the top panel 110 and by an inside front panel 128 hinged at a double score line 130 on the bottom edge of the outside front panel 124. Tabs 132, 134, and 136 are formed on the top edge of the inside front panel 128 and correspond to respective slots 138, 140 and 142 formed at the front edge of the top panel 110 for receiving the tabs 132, 134 and 136. Tuck-in flaps 144 and 146 are hinged at respective score lines 148 and 150 on the front edges of the narrow side panels 112 and 114 for being sandwiched between the outer portions of the outside front panel 124 and inside front panel 128. A horizontal slot 152 is formed within a central portion of the inside front panel 128 while an opening 154 is formed in the outside front panel 124 so as to be aligned with the slot 152 when the panel 128 is folded inside the panel 124. The slot 152 has a substantial width so as to form a locking edge 156 on the inside front panel 128 at the lower edge of the slot 152.

The body portion 20 and the liner 22 are made from a heavy weight or relatively strong corrugated paperboard having single, double or triple laminated layers of corrugations, or the like, while the bottom flap 24 and the top 26 are made from a relatively light weight corrugated paperboard. Since the strength of the paperboard is directly dependent on the weight (i.e. the weight or amount of material per unit area) and the thickness of the paperboard sheet or panel, the body portion 20 and the liner 22 have a substantially greater strength than the bottom flap 24 and top 26 which are formed from lighter materials.

When the container is assembled as shown in FIG. 1, the outside surfaces of the inner wall panels 86, 88, 90 and 92 are bonded or laminated with the inside surfaces of the wall panels 30, 32, 34 and 36 of the body portion 20 by glue or the like as indicated by the stipling. Similarly the joint flap 100 of the liner 22 is joined with the liner panel 92 and the outside joint flap 44 of the body 20 is joined with the panel 30 to form an enclosed wall. The portion 108 of the bottom flap 24 is attached to the short bottom flap 48 by glue, staples, or the like (see FIG. 8) while the rear portion 122 of the top 26 is similarly attached to the short top flap 64 (see FIG. 6). The panel 104 and the short flap 48 are folded inward until the edges of the panel 104 engage the bottom edges of the liner panels 88, 90 and 92 to square up the walls of the container as well as to accurately position the panel 104. The other short bottom flaps 50, 52 and 54 are suitably folded to overlap the edges of the bottom panel 104 and may also be attached thereto by glue, staples, or the like.

The top 26 is assembled by folding the short side panels 112 and 114 downward about the score lines 116 and 118 on opposite sides of the container and bending the tuck-in tabs 144 and 146 around the front side of the container. Then the front panels 124 and 128 are folded downward over the tuck-in tabs 144 and 146 with the inside front panel 128 being folded back up inward over the insides of the tuck-in panels 144 and 146 with the tabs 132, 134 and 136 being engaged in the respective slots 138, 140 and 142 to form the top.

In use the short top flaps 66 and 70 are folded inward while the front flap means 68 is folded outward and downward. The top 26 and short flap 64 are pivoted downward about the score line 72 placing the side panels 112 and 114 on the sides of the container and placing the front panel means on the front of the container. The tab 80 is engaged into the slot 152 where the end of the tab 80 engages or abuts with the locking edge 56 to prevent upward movement of the top 26. The resilience of the paperboard material forming the body 20 causes the flap 68 to be biased outward away from the front panel 34 so as to urge the flap 68 toward the inside panel 128 of the top 26 and to hold the tab 80 engaged in the slot 156. This firmly secures the top 26 in a closed position.

When it is desired to release the top 26, an elongated member or finger may be inserted through the opening 154 to push the tab 156 back toward the front panel 34 of the body until it is disengaged from the locking edge 156. Then the top 26 can be hinged upward to open the container.

The top 26 as well as the short top flaps 64, 66, 68 and 70 substantially reduce the top bulging of the container under weight of bulk material therein. The top cap being locked into position eliminates the need for steel straps or tapes necessary to hold top caps or the like on prior art containers. The employment of the opening 154 in alignment with the tab 80 when the top is closed so that the tab can be easily disengaged from the locking edge 156 renders the top easily openable without tearing, bending or otherwise destroying the top 26.

Figure 7:
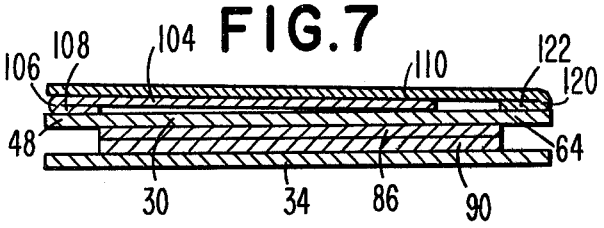
FIG. 7 is a cross section view of the container of FIG. 1 in a folded condition.

After the container is used, it may be refolded in the manner as illustrated in FIG. 7 to permit the container to be shipped back to its original location so that it may be subsequently used again. In folding the container the bottom flap 104 is folded over at the score line 106 on top of the folded container while the top is disassembled and then folded over at the score line 120. This permits the container to remain a unitary body and to be stacked in a small space without having large extending portions. The lesser thicknesses of the panels 110 and 104 results in substantially less uneveness in the folded container than if such panels were made from the same weight of paperboard as the body 20 and the liner 22. Since the hinged top 26 and bottom 24 are fixed on the body 20, separate inventories of bodies, tops and bottoms are eliminated.

Figure 9:
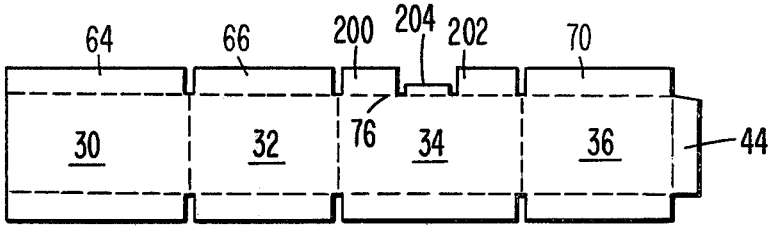
FIG. 9 is a plan view of a blank for forming a body portion of a modified container in accordance with the invention.
Figure 10:
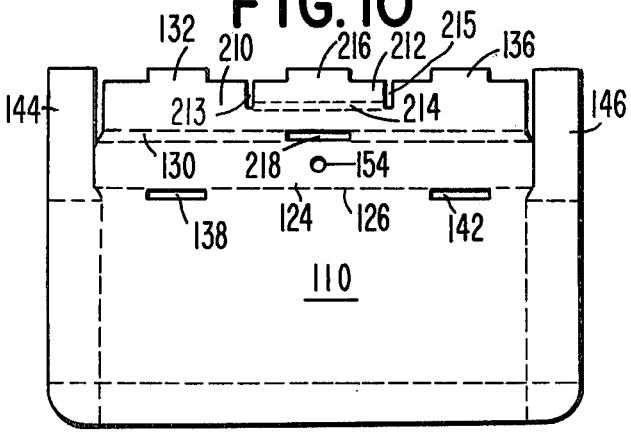
FIG. 10 is a plan view of a blank for forming a top of the modified container employing the body portion of FIG. 9.
Figure 11:
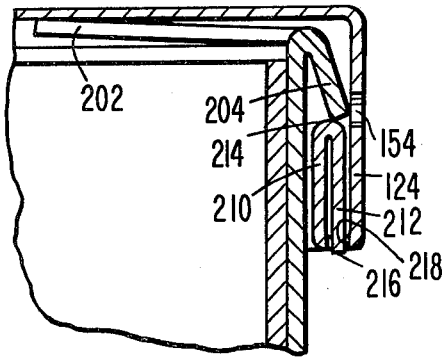
FIG. 11 is a cross section view of a top portion of the modified container employing the body portion of FIG. 9 and the top of FIG. 10.

In a modification of the container illustrated in FIGS. 9, 10 and 11, flaps 200 and 202 and a center tab 204 are substituted for the front flap 68 on the body portion 20 of FIGS. 2 and 6 and are also hinged on the double score line 130. The flaps 200 and 202 have the same width as the flaps 64, 66, and 70 while the center tab 204 is substantially narrower. Also a modified inside front panel 210 is substituted for the panel 128 (FIG. 5) in the top 26. The inside front panel 210 contains the same tabs 132 and 136 as the panel 128 of FIG. 5 but at the center portion thereof a double horizontal score line 214 and vertical cuts 213 and 215 from the distal edge are formed to form a fold-in portion 212. The fold-in portion 212 has a tab 216 formed on the bottom edge thereof while a slot 218 is formed along the score line 130 to receive the tab 216. The assembly of the modified container is similar to the container of FIGS. 1–8 except that the fold-in portion 212 is folded in as the inside front panel 210 is folded about the tuck-in tabs 144 and 146 to engage the tab 216 in the slot 218. The upper edge of the hinge 214 between the portion 212 and panel 210 forms a locking edge on the inside front panel. In use the side flaps 200 and 202 are bent inward in the same manner as the narrow top flaps 66 and 70 while the tab 204 is folded outward and downward. Then the top is hinged downward until the tab 204 is engaged with the locking edge 214. The tab 204, due to the resilience of the paperboard forming the body 20, is biased outward to insure the engagement of the tab with the locking edge 214. The tab 204 can be easily disengaged from the locking edge 214 by inserting a finger through the opening 154 and pushing the tab 204 toward the front panel 34 until the tab 204 disengages from the edge 214; thus the cover can be released.

Figure 12:
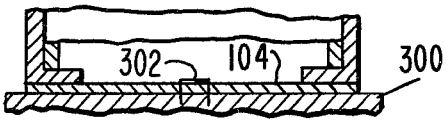
FIG. 12 is a cross section view of a bottom portion of a further modified container in accordance with the invention.
Figure 13:
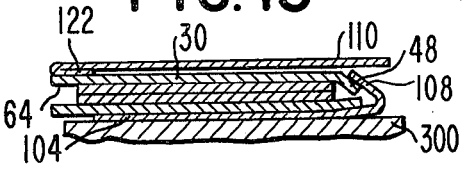
FIG. 13 is a cross section view of the modified container of FIG. 12 in a folded condition.

In a further modification of the invention shown in FIGS. 12 and 13, the bottom flap 104 is affixed to a pallet 300 by any suitable means such as staples 302. The container can be folded flat on top of the pallet 300 as illustrated in FIG. 13 for return shipping. In this modification, the pallet also forms a unitary structure with the container and thus separate inventories of pallets and containers as well as tops are not necessary.

Since the present invention is subject to many modifications, variations and changes in detail, it is intended that all matter in the foregoing description or shown in the accompanying drawings be interpreted as illustrative and not in a limiting sense.

What is claimed is

1. A bulk material container comprising an integral body including four side body panels with means serially connecting the body panels for forming an enclosed wall;

bottom means for closing the bottom of the enclosed wall;

a top hinged on a top edge of a rear body panel of the four body panels;

said top including a top panel for covering the top of the enclosed wall, two narrow top side panels for extending downward over top portions of respective opposite side body panels of the four body panels, and front panel means for extending downward over a top portion of a front body panel of the four body panels;

said front panel means including outside panel means and inside panel means for being folded inside the outside panel means;

said inside panel means including means for forming a horizontal locking edge spaced below a front top edge of the front body panel;

tab means hinged on the front top edge of the front body panel for being bent outward and downward to permit closing of the top but being resilient so as to be biased outward to engage the locking edge;

said outside panel means and said inside panel means having an opening therethrough in alignment with the tab means for permitting forcing of the tab means toward the front body panel to disengage the tab means from the locking edge;

short top flaps hinged on the top edges of the rear and opposite side panels of the four body panels at the top end of the body;

said top panel overlapping and being secured to the short top flap hinged on the rear body panel;

said tab means including a tab hinged on a central portion of the top edge of the front body panel; and two flaps hinged on the top edge of the front body panel on respective opposite sides of the tab.

2. A bulk material container as claimed in claim 1 wherein the means for forming a horizontal locking edge includes a fold-in portion for being folded inward from the inside panel means.

3. A bulk material container as claimed in claim 1 including a liner having panels secured to the inside surface of the respective side panels of the body, said liner having top edges and bottom edges adjacent the top and bottom edges of the body panels; and wherein said integral body includes short bottom flaps hinged on the bottom edges of the side panels, said bottom means includes a large flap overlapped and secured to one of the short bottom flaps and adapted to overlap and be secured to the other short bottom flaps to close the bottom of the enclosed wall, and said large flap has dimensions selected to engage edge portions of the large flap against the edges of the liner panels adjacent the bottom of the body.

4. A bulk material container as claimed in claim 3 wherein said top and said large flap are formed from a corrugated paperboard having a first weight, and said body and liner are formed from a corrugated paperboard having a second weight, said first weight being substantially less than said second weight.

5. A bulk material container as claimed in claim 3 including a pallet, and wherein the large flap is affixed to the pallet.

6. A bulk material container as claimed in claim 3 wherein the large flap has a score line adjacent the edge of the one bottom short flap opposite the hinge of the one bottom short flap for being folded over the one bottom short flap, and said top has a score line adjacent the edge of the one short top flap hinged on the rear body panel for being folded over the short top flap on the rear body panel.

* * * * *

UNITED STATES PATENT AND TRADEMARK OFFICE

CERTIFICATE OF CORRECTION

PATENT NO. : 4,127,230

DATED : November 28, 1978

INVENTOR(S) : Robert A. Bamburg et al

It is certified that error appears in the above-identified patent and that said Letters Patent are hereby corrected as shown below:

Column 4 line 30, change "56" to -- 156 --,

Column 4 line 36, change "156" to -- 152 --,

Column 4 line 40, change "156" to -- 80 --.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*